US005876853A

United States Patent [19]

Gallant

[11] Patent Number: 5,876,853

[45] Date of Patent: Mar. 2, 1999

[54] ROLLS HAVING RELEASE COATINGS

[75] Inventor: James O. Gallant, Attleboro, Mass.

[73] Assignee: Stowe Woodward Industries, Inc., Wellesley Hills, Mass.

[21] Appl. No.: 851,737

[22] Filed: May 6, 1997

Related U.S. Application Data

[63] Continuation-in-part of Ser. No. 539,200, Oct. 4, 1995, abandoned.

[51] Int. Cl.[6] ..... B32B 27/00

[52] U.S. Cl. ..... 428/423.3; 427/407.1; 428/480; 492/48; 492/53

[58] Field of Search ..... 428/41.4, 41.5, 428/41.8, 42.3, 202, 344, 352, 447, 423.3, 480; 427/407.1; 492/48, 53

[56] References Cited

U.S. PATENT DOCUMENTS

| | | | |
|---|---|---|---|
| 2,393,191 | 1/1946 | Robertson | 26/63 |
| 4,154,894 | 5/1979 | Sattler et al. | 428/458 |
| 4,313,988 | 2/1982 | Koshar et al. | 428/40 |
| 4,362,263 | 12/1982 | Kwiecinski | 228/263 |
| 4,481,258 | 11/1984 | Sattler et al. | 428/371 |
| 4,675,234 | 6/1987 | Sachs et al. | 428/328 |
| 5,013,631 | 5/1991 | Su | 430/271 |
| 5,213,875 | 5/1993 | Su et al. | 428/209 |
| 5,397,813 | 3/1995 | Eckberg et al. | 522/31 |

*Primary Examiner*—Bernard Pianalto
*Attorney, Agent, or Firm*—Myers Bigel Sibley and Sajovec

[57] ABSTRACT

A release coating suitable for on bowed rolls, press rolls, and other machine elements comprises an adhesive layer and a release layer. The adhesive layer includes an acrylated monomer, an acrylated urethane, and a diacrylated aromatic monomer. The release layer includes these three components and an acrylated polysiloxane. With these components, the release coating has superior release properties as well as good abrasion resistance and hardness.

9 Claims, 12 Drawing Sheets

ROLLS HAVING RELEASE COATINGS

RELATED APPLICATIONS

This application is a continuation-in-part of U.S. patent application Ser. No. 08/539,200, filed on Oct. 4, 1995, abandoned, which is hereby incorporated herein in its entirety by reference.

FIELD OF THE INVENTION

This invention relates generally to finish coatings for industrial rolls, and more particularly to rolls having release coatings.

BACKGROUND OF THE INVENTION

Covered rolls are used in demanding industrial environments in which they are subjected to high dynamic loads and temperatures. Covered rolls can be used not only for transporting material under process, which is often in the form of a travelling web, but also for processing the web itself into a finished product.

A bowed roll is a specific variety of industrial roll used to correct web distortion and similar problems by distributing lateral tension evenly across a travelling web. For example, bowed rolls can be used to spread out or expand the travelling web for the purposes of maintaining width, eliminating wrinkles, eliminating baggy centers or slack edges. Bowed rolls can also be used to control felts by maintaining their width, openness and seams, and to eliminate interleaving of individual slit webs on winders.

A press roll is another type of industrial roll which is typically employed in nip presses. Press rolls process the travelling web by compressing the web at the nip between the rolls. Typically, this is done to remove liquids from the web (such as in dewatering presses), or to eliminate high and low spots in a finished product (such as in finish nip presses).

Bowed rolls and press rolls often include elastomeric sleeves or compliant elastomeric covers, particularly when they are employed in processes in which a web under process is coated with surface enhancing materials that are tacky. As a result, these materials are susceptible to transferring from the web to the surface of the roll, which can result in the degradation of the surfaces of the roll and the web. As such, it is desirable to have such rolls coated with a material that it is self-cleaning (i.e., it can release material that would otherwise tend to adhere to it).

At present, industrial rolls having release surfaces are treated with epoxies, urethanes, PTFE polymers, silicones or waxes. Epoxies and urethanes have desirable abrasion resistance properties, but typically lack the desired high release properties and low coefficients of friction. PTFE polymers and silicones have high release properties and low coefficients of friction, but generally lack high abrasion resistance qualities. Waxes and silicone polish coatings typically lack durability.

SUMMARY OF THE INVENTION

In view of the foregoing, it is an object of the present invention to provide a release coating that can be applied to metallic or nonmetallic surfaces of an industrial roll.

It is another object of the present invention to provide a release coating for a machine element that is abrasion resistant yet compliant enough to be applied to machine elements requiring flexible surfaces.

These and other objects are satisfied by the present invention, which provides a release coating for the surface of a roll or other machine element with a desirable balance of releasability and abrasion-resistance. The release coating comprises an adhesive layer and one or more overlying release layers. The initial adhesive layer of the present invention is a liquid composition of 100% solids comprising an acrylated monomer, an acrylated urethane, and an aromatic diacrylate monomer. The acrylated monomer of the adhesive layer is included to provide resilience, compliance, and flexibility to the coating. The acrylated monomer may be a compound of Formula I $$\text{Acr}—R_1 \qquad \text{(I)}$$

wherein Acr is an acrylate group of Formula II $$H_2C{=}CR_2—\overset{\overset{\displaystyle O}{\|}}{C}—O— \qquad \text{(II)}$$

with $R_2$ being H, methyl or ethyl, and wherein $R_1$ is alkyl, aryl, alkyl aryl, alkoxy, alkoxy aryl, alkoxy alkyl, any of which may be unsubstituted or substituted from 1 to 6 times with methyl, ethyl, methoxy, ethoxy, or hydroxyl, or one time with epoxy. Alternatively, the acrylated monomer may be a compound of Formula III $$\text{Acr}—R_3—\text{Acr} \qquad \text{(III)}$$

wherein Acr is as defined hereinabove, and $R_3$ is alkyl, aryl, alkyl aryl, alkoxy, alkoxy aryl, alkoxy alkyl, any of which may be unsubstituted or substituted from 1 to 6 times with methyl, ethyl, methoxy, ethoxy, or hydroxyl, or one time with epoxy. The acrylated urethane is a compound of Formula IV $$\text{Acr}—R_4—O—\overset{\overset{\displaystyle O}{\|}}{C}—NH—R_5—\text{Acr} \qquad \text{(IV)}$$

wherein Acr is as defined hereinabove, and $R_4$ and $R_5$ are alkyl, aryl, alkyl aryl, alkoxy, alkyl alkoxy, aryl alkoxy, alkyl amino, aryl amino, or aryl alkyl amino, each of which is unsubstituted or substituted from one to four times with methyl, ethyl, or hydroxyl. The diacrylated aromatic monomer is a compound of Formula V $$\text{Acr}—R_6—\text{Acr} \qquad \text{(V)}$$

wherein Acr is as defined hereinabove, and $R_6$ is aryl, alkyl aryl, alkoxy aryl, or alkoxy alkyl aryl, each of which can be unsubstituted or substituted between 1 and 6 times with methyl or hydroxy.

The release layer of the present invention comprises an acrylated monomer, an acrylated urethane, an aromatic diacrylate monomer, and an acrylated polysiloxane. The compounds comprising the acrylated monomer, acrylated urethane, and aromatic diacrylate monomer are as described above for the adhesive layer. The acrylated polysiloxane is a compound of Formula VI $$\text{Acr}—R_8—\overset{\overset{\displaystyle R_7}{|}}{\underset{\underset{\displaystyle R_7}{|}}{\overset{\overset{\displaystyle O}{|}}{\underset{\underset{\displaystyle O}{|}}{Si}}}}—O—R_7 \qquad \text{(VI)}$$

wherein Acr is as defined above, $R_7$ is alkyl, and $R_8$ is alkyl that is unsubstituted or substituted 1 or 2 times with methyl or hydroxy.

A coating having this composition has superior release properties while retaining good abrasion resistance and hardness. This balance of properties renders the coating suitable for any number of machine elements, including industrial rolls.

Preferably, the adhesive and release layers also include one or more photoinitiators that initiate and propagate curing under irradiation with electromagnetic radiation. As such, these compositions can be applied and curing either during manufacture or on-site quickly and easily with conventional equipment.

DESCRIPTION OF THE PREFERRED EMBODIMENT

Figure 1:
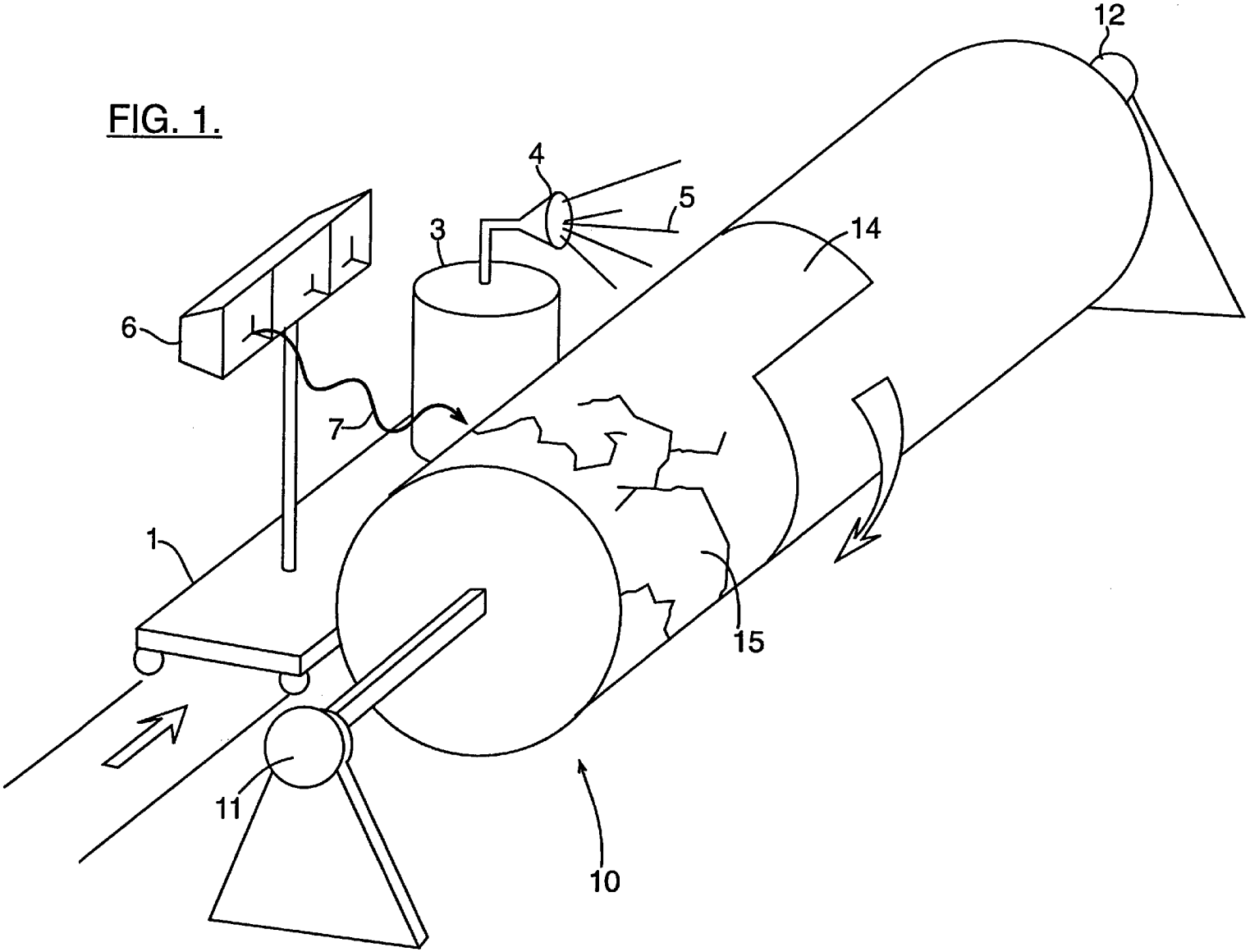
FIG. 1 is a perspective view illustrating the application of an adhesive coating to a machine element in accordance with the present invention.

The present invention will now be described more particularly hereinafter with reference to the accompanying drawings, in which present embodiments of the invention are shown. The invention may, however, be embodied in many different forms and is not limited to the embodiment set further herein; rather, these embodiments are provided so that the disclosure will fully convey the scope of the invention to those skilled in this art.

As noted hereinabove, the release coating of the present invention is a composite coating, typically and preferably comprising multiple release layers applied over an initial adhesive layer. The components of the individual layers are described hereinbelow.

The initial adhesive layer of the present invention is a liquid composition of 100% solids comprising an acrylated monomer, an acrylated urethane, and an aromatic diacrylate monomer. The acrylated monomer of the adhesive layer is included to provide resilience, compliance, and flexibility to the coating. The acrylated monomer may be a compound of Formula I or of Formula III, each of which is defined hereinabove.

If the acrylated monomer is a compound of Formula I, it is preferred that $R_2$ be hydrogen, and that $R_1$ be aryl, alkyl aryl, or alkoxy aryl, with unsubstituted alkoxy aryl and alkoxy aryl substituted with hydroxy being particularly preferred. An exemplary compound in which $R_1$ is alkoxy aryl and $R_2$ is hydrogen is 2-phenoxyethyl acrylate; other exemplary compounds include: 2-phenoxyethyl methacrylate; lauryl acrylate; lauryl methacrylate; stearyl acrylate; stearyl methacrylate; 2 (2-ethoxyethoxy) ethylacrylate; isodecylmethacrylate; and glycidyl methacrylate.

If the acrylated monomer is a compound of Formula III, it is preferred that $R_2$ be hydrogen, and that $R_3$ be alkyl, aryl, or alkyl aryl, with unsubstituted alkyl and alkyl substituted with hydroxyl being more preferred. An exemplary compound of Formula III in which $R_2$ is hydrogen and $R_3$ is alkyl is 1,6 hexanediol diacrylate. Other exemplary compounds of Formula III include: 1,6 hexanediol methacrylate; diethylene glycol diacrylate; 1,4 butanediol diacrylate; 1,4 butanediol dimethacrylate; polyethylene glycol dimethacrylate; ethylene glycol dimethacrylate; diethylene glycol dimethacrylate; triethylene glycol dimethacrylate; and tetraethylene glycol dimethacrylate.

The acrylated monomer can be included in the adhesive layer either as a single compound or as a combination of compounds. It is particularly preferred that a compound of Formula I be combined with a compound of Formula III in the adhesive layer. The adhesive layer should include between about 30 and 60 percent by weight of the acrylated monomer, with a weight percent of between 40 and 55 percent being preferred.

The diacrylated urethane of the adhesive layer is included to provide resilience, compliance, and flexibility thereto. As stated hereinabove, the acrylated urethane is a compound of Formula IV, with $R_4$ and $R_5$ being defined as stated. It is preferred that $R_4$ be unsubstituted alkyl or alkyl substituted with methyl or hydroxyl, and that $R_5$ is alkyl aryl amino. A particularly preferred acrylated urethane is CN 972 (available from Sartomer Company, Inc., Stratford, Conn.), which has the structure

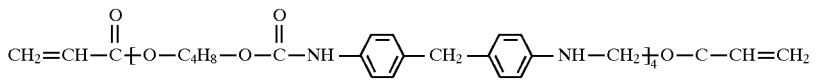

Other suitable diacrylated urethanes include compounds CN 970, CN 971, and CN 973, each of which is available from Sartomer Company.

The adhesive layer should include between about 20 and 40 percent by weight of the diacrylated urethane, with a weight percent of between about 25 and 35 percent being preferred. The diacrylated urethane can be combined with 1,6 hexanediol diacrylate or another diacrylated monomer to lower its viscosity and thereby facilitate its use. Generally, an increase in the percentage of acrylated urethane increases the flexibility of the adhesive layer.

The diacrylated aromatic monomer is included in the compound to provide abrasion resistance. As stated, the diacrylated aromatic monomer is a compound of Formula V, with Acr and $R_6$ being as defined above. Preferably, $R_6$ is alkoxy alkyl aryl, and more preferably $R_6$ contains at least two aromatic groups separated by an alkyl group, with the aromatic groups being bonded to the Acr groups via unsubstituted or hydroxy substituted alkoxy groups. A particularly preferred compound of Formula V is ethoxylated bisphenol A diacrylate

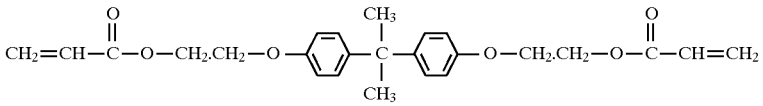

Other suitable compounds include: dihydroxy ethoxylated bisphenol A diacrylate; ethoxylated bisphenol A dimethylacrylate; and dihydroxy ethoxylated bisphenol A dimethacrylate.

The compounds of Formula V may be included as a single compound or a combination of two or more compounds. In addition, other compounds, such as epoxides or diepoxides, can be blended with one or more compounds of Formula V. The diacrylated aromatic monomer is included in the adhesive layer such at it comprises between about 10 and 30 percent of the adhesive layer by weight, with a weight percent of between about 15 and 25 percent being preferred. Generally, an increase in the percentage of diacrylated aromatic monomer increases the rigidity of the adhesive layer.

Additional components can also be included in the adhesive layer. For example, the inclusion of one or more free radical photoinitiators, such as isobutyl benzoin ether, benzil methyl ketal, or benzophenone, can be used to initiate and propagate polymerization upon exposure of the material to light or other electromagnetic radiation. Alternatively, or in combination, the polymerization reaction can be initiated with a cationic photoinitiator such as triarylsulfonium hexafluoroantimonate salt (CD 1010, available from Sartomer Company) or a triaryl sulfonium hexafluorophosphate (CD 1011, available from Sartomer Company). When exposed to electromagnetic radiation, these photoinitiators generate free radicals and/or cationic particles which initiate the formation of cross-linking bonds among the polymers and the siloxane. Several different kinds and combinations of photoinitiators can be used as described in the text, "Radiation Curing Science and Technology," Edited by S. Peter Papas, (1992 Plenum Press).

The photoinitiator can be supplemented with a tertiary amine, such as CN 383 (available from Sartomer Company), that extends curing beyond the exposure to light. Photoinitiators typically comprise between about 0.25 and 2.5 percent of the adhesive layer by weight. Other highly reactive monomers, like methacrylates such as glycidylmethacrylate, can be included to promote polymerization.

In addition, an adhesion enhancer, such as a monofunctional or trifunctional acid ester or a trifunctional acrylate ester, can be mixed into the adhesive layer. The adhesive enhancer should be included at a weight percent of between about 0.5 and 1.5 percent.

The release layer of the present invention comprises an acrylated monomer, an acrylated urethane, an aromatic diacrylate monomer, and an acrylated polysiloxane. This combination produces a liquid phase reaction of the acrylated polysiloxane and aromatic diacrylate monomer, thereby creating a suspended precipitate of aromatic polysiloxane in a predominantly acrylated urethane and acrylated monomer solution. The compounds comprising the acrylated monomer, acrylated urethane, and aromatic diacrylate monomer are as described above for the adhesive layer. It is preferred that these components be the same in both the adhesive and release layers and that they be included in the release layer in the same relative ratios to one another. This composition both simplifies production and improves interlamination adhesion.

As stated hereinabove, the acrylated polysiloxane is a compound of Formula VI, wherein Acr, $R_7$, and $R_8$ are as defined. Preferably, $R_7$ is methyl for all substituents, and $R_8$ is unsubstituted alkyl. An exemplary and preferred polysiloxane is trimethoxy propylmethacrylate siloxane. The polysiloxane should be comprise between about 5 and 20 percent by weight of the release layer, with a weight percent of between 10 and 15 percent being preferred.

Other compounds, such as those described hereinabove, can be added to the base components of the release layer. In addition to the photoinitiators, reactive monomers, and adhesion enhancers discussed, an adhesion release enhancer, such as a fluorinated alkyloxylate, can also be included to impart additional release properties to the release layer. Also, fillers that can increase individual coating thicknesses or reduce production costs can also be added. Preferably, fillers are selected that are unaffected by the curing technique; for example, if the release layer is to be cured with ultraviolet light, the filler should be transparent to ultraviolet light.

The release coating, including the initial adhesive layer and one or more release layers, can be applied to machine elements located at end-users facilities, thus reducing manufacturing costs and facilitating emergency repairs. The adhesive and release layers can either be prepared concurrently in separate mixing vats or consecutively by adding the acrylated polysiloxane after the application of the initial adhesive layer. The adhesive and pre-reacted release coatings can be applied to flexible or rigid substrates, such as bowed rolls, press rolls or carrying rolls.

Through the addition of the aforementioned photoinitiators, both the adhesive and release coatings can be cured through irradiation thereof with electromagnetic radiation ranging in wave length from about 5500 Å. through 6 Å (i.e., long wave ultraviolet down to short wave gamma rays). Alternatively, electron beam bombardment can be employed to cure the coatings without the use of photoinitiators.

FIG. 1 illustrates how the adhesive coating of the present invention can be applied to a roll 10 mounted rotatably in bearings 11 and 12. A traverse carriage 1 travels longitudinally in a reciprocating fashion alongside the roll 10. A mixing vessel 3, which contains the components comprising the adhesive coating, and an ultraviolet lamp 6 are mounted on top of the traverse carriage 1. A sprayhead 4 is mounted atop the mixing vessel 3. The sprayhead 4 applies liquid adhesive coating 5 to the roll 10 to form an adhesive layer 14 thereon. The ultraviolet lamp 6 emits ultraviolet radiation 7 to partially cure the adhesive layer 14. The partial curing creates good adhesion between the initial adhesive layer 14 and the roll 10 and provides a partially reacted reactive film 15 on the outer surface for subsequent bonding with additional layers of release coating.

Figure 2:
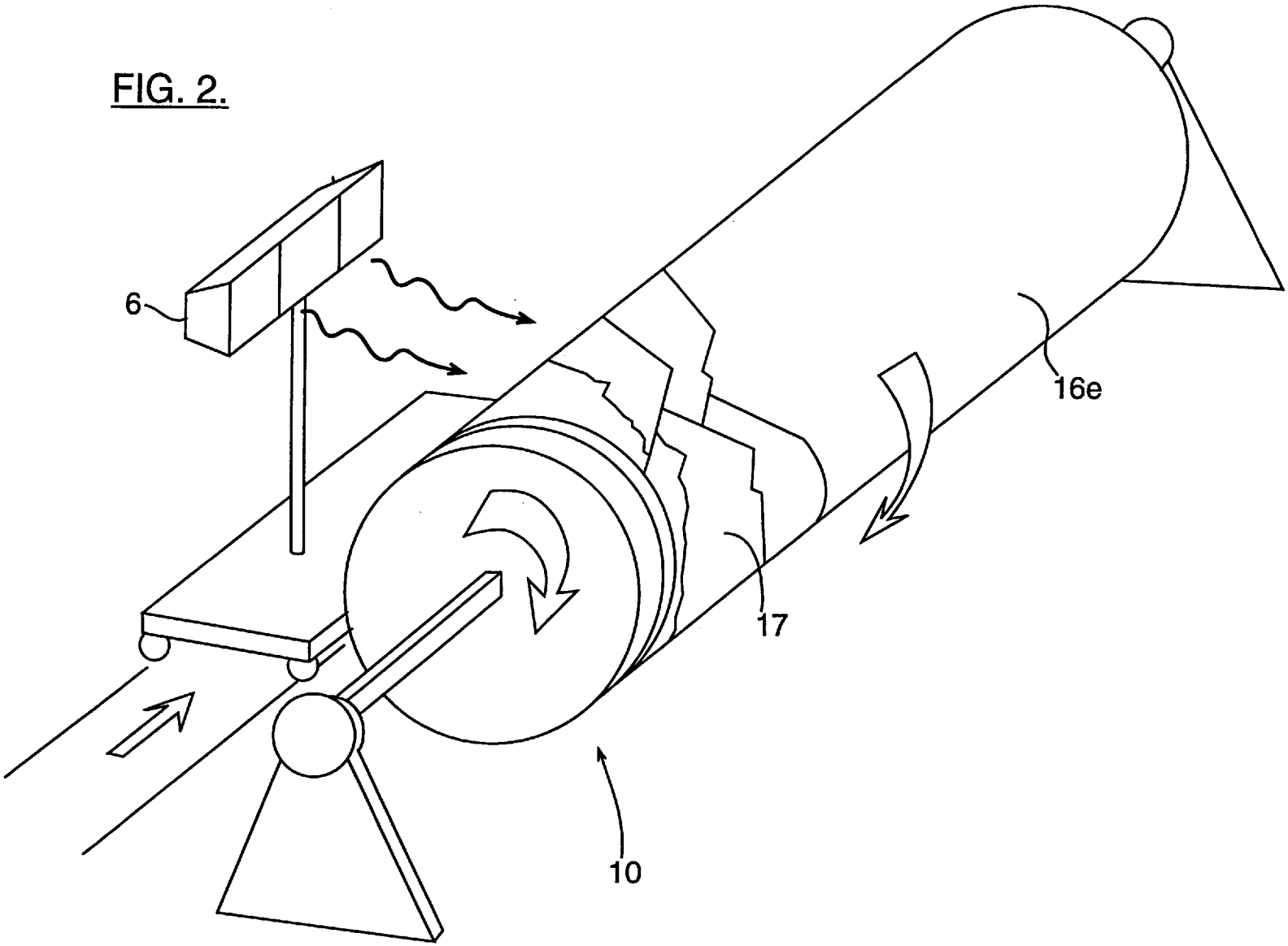
FIG. 2 is a perspective view illustrating the curing of a final release layer on the machine element of FIG. 1.
Figure 3:
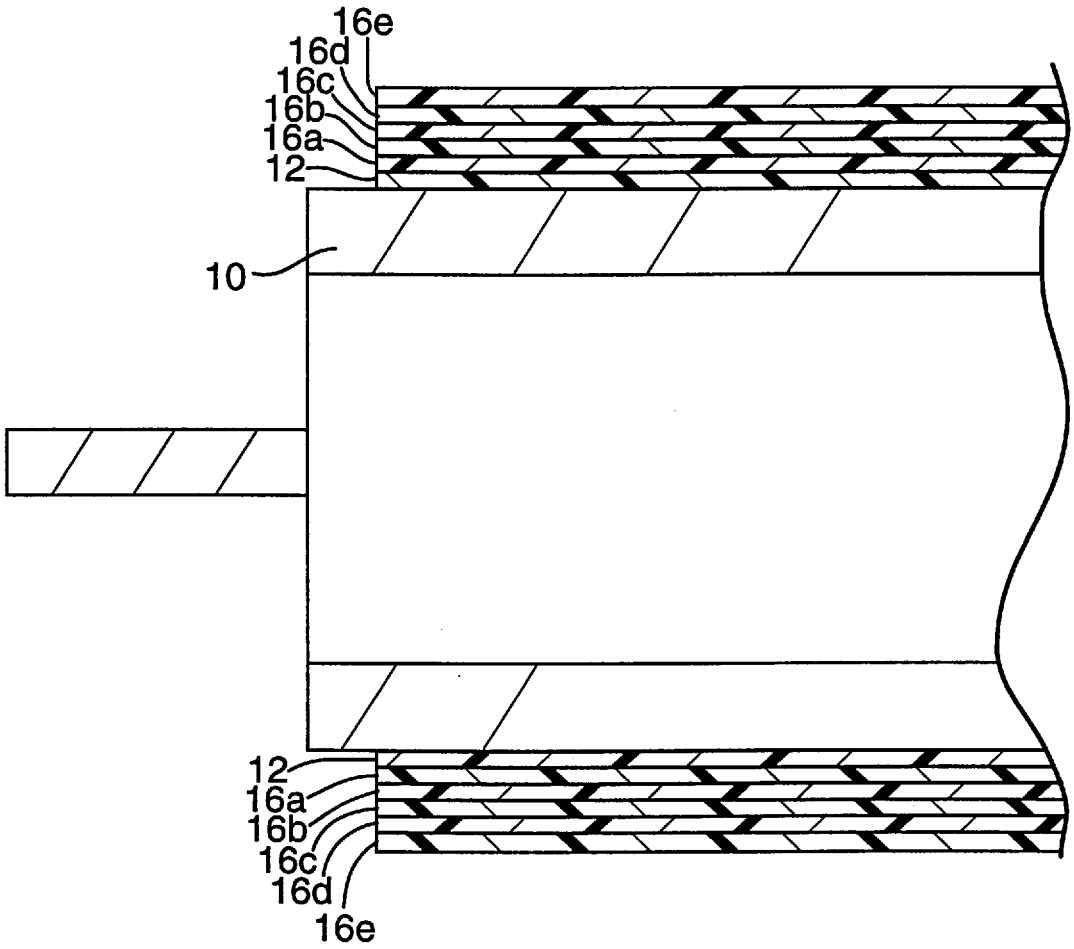
FIG. 3 is a sectional view of the machine element of FIG. 2 covered with a release coating of the present invention having a multiplicity of release layers applied over an adhesive substrate layer.

After the adhesive layer 14 is partially cured, a series of overlying release layers 16*a,* 16*b,* 16*c,* 16*d,* 16*e* is applied in much the same manner as the adhesive layer 14 (FIGS. 2 and 3). After a desired number of layers of the release coating are applied (in this instance five layers), the roll 10 is finally cured with the ultraviolet lamps 6. After curing, the finished release layer 17 is a matrix comprising hard sites of cross-linked ethoxylated polysiloxane acrylate dispersed in a flexible lower modulus binder of cross-linked polyurethane acrylate and acrylated monomer. Typically, the final release coating 17 (comprising the adhesive layer 12 and the release layers 16*a*–16*e*) is cured with more intense and shorter wave length energy.

Figure 4A:
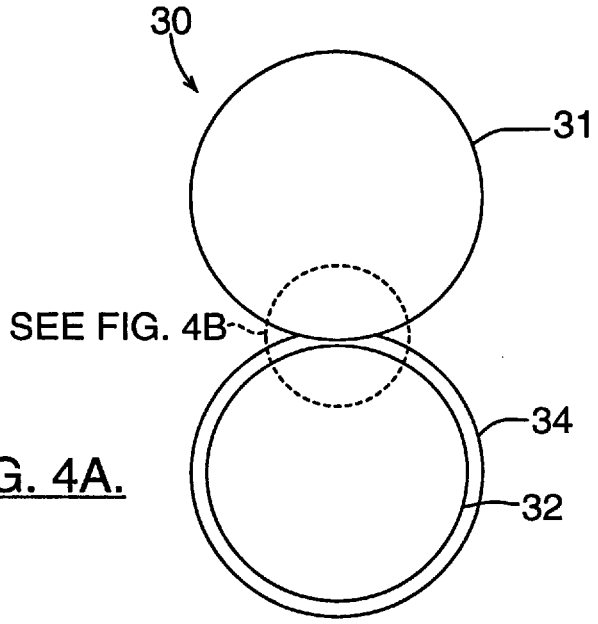
FIG. 4A is a sectional view of a pair of cylindrical nip rolls, the lower one of which is covered with the release coating of the present invention.
Figure 4B:
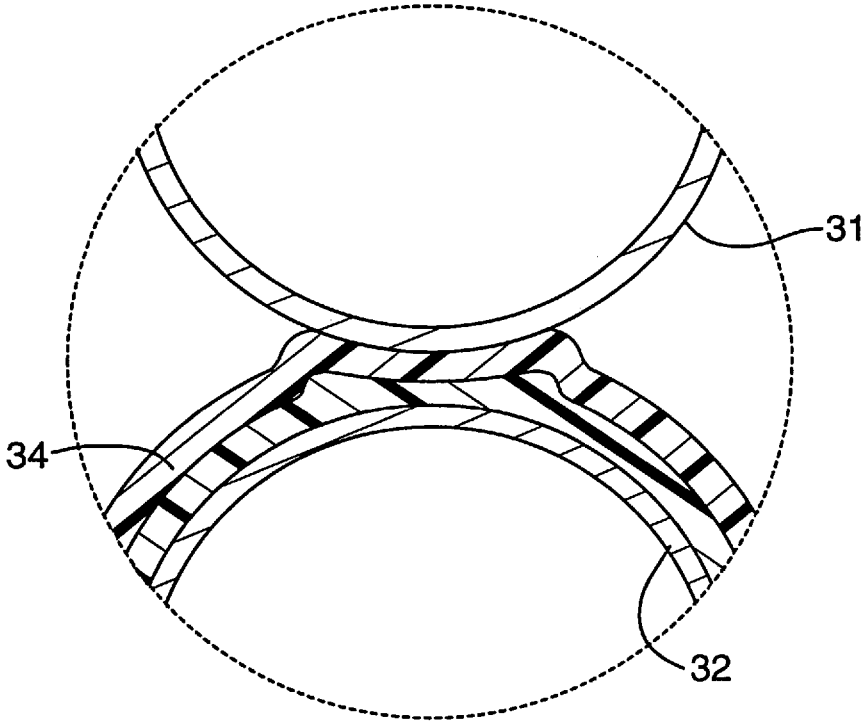
FIG. 4B is an expanded sectional view of the encircled area in FIG. 4A illustrating how the flexible release coating of the present invention can withstand deformation caused by a corresponding nip roll.

Referring now to FIGS. 4A and 4B, a nip press 30 illustrated therein and suitable for receipt of the release layer of the present invention comprises upper and lower nip rolls 31, 32, with the lower roll 32 being coated with a flexible release coating 34 of the present invention (for illustrative purposes, the travelling web or sheet under process is not shown). FIG. 4B, which is an enlargement of the encircled area of FIG. 4A, shows how the release coating 34 of the present invention can flex sufficiently to withstand a deformation caused by the contact pressure between the nip rolls 31, 32.

Figure 5A:
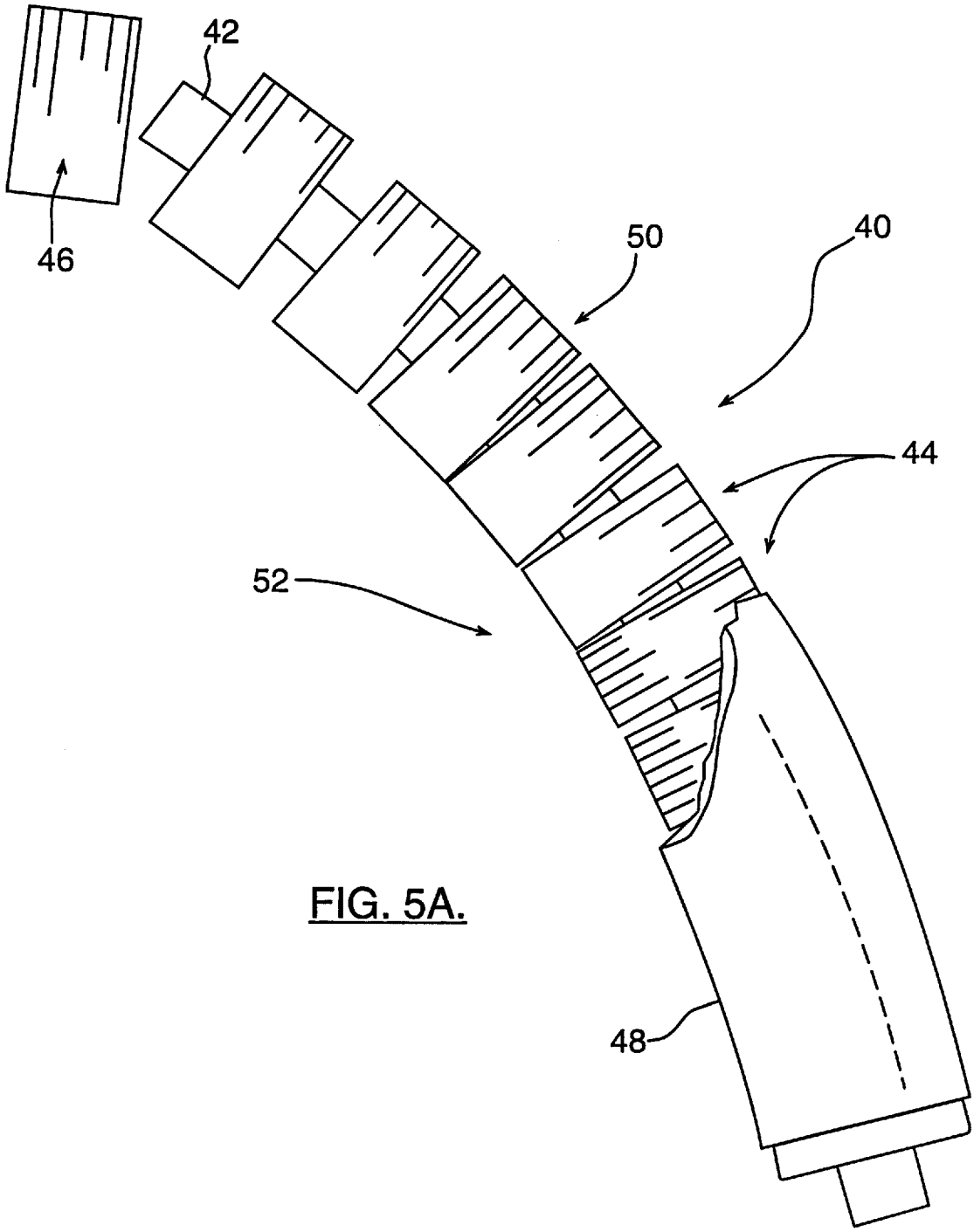
FIG. 5A is a partial cutaway view of a bowed roll illustrating an elastomeric roll cover coated with a release coating of the present invention.
Figure 6A:
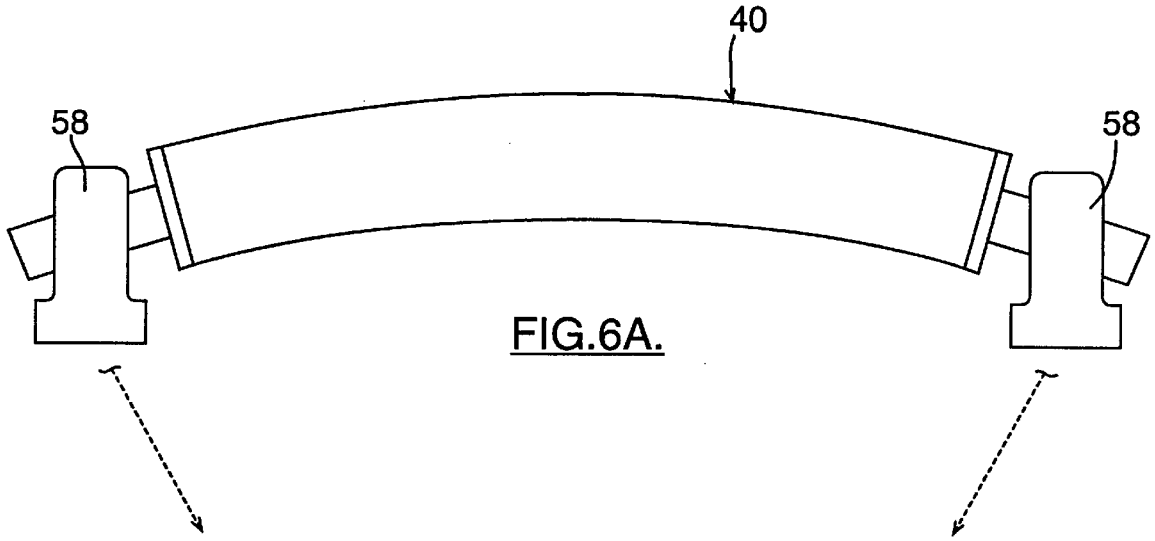
FIG. 6A is a side view illustrating the bowed roll of FIG. 5A.
Figure 6B:
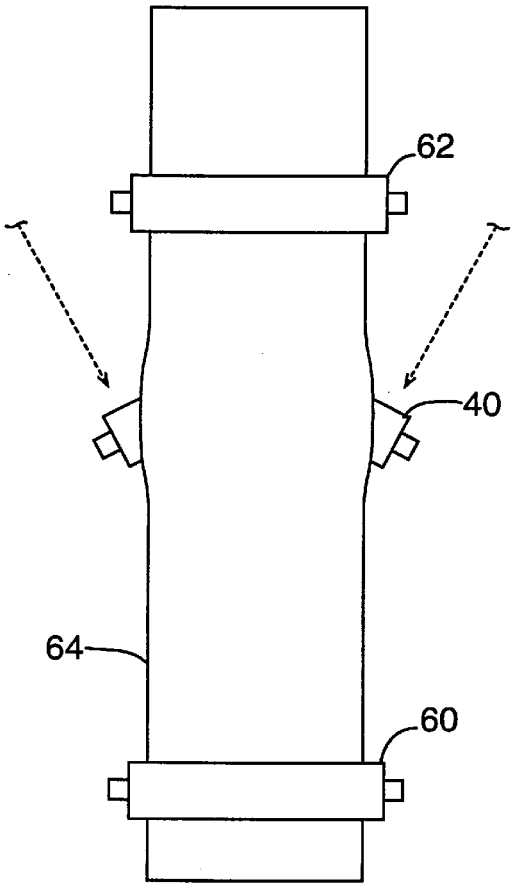
FIG. 6B is a diagram illustrating the placement of bowed roll of FIGS. 5A, 5B and 6A in processing a viscid web.

FIGS. 5A, 6A and 6B illustrate how the release coating of the present invention can be employed with a bowed roll. The bowed roll 40 comprises a non-rotating axle 42, a plurality of ball bearing assemblies 44, a plurality of bearing shells 46, and an outer sleeve 48. The axle 42 is curved to provide the degree of bow desired for a specific roll operation. The ball bearing assemblies 44 are mounted on the axle 42 so that their outer races (not shown) are free to rotate about the axle 42, while the inner races (not shown) of the ball bearing assemblies 44 are held stationery on the axle 42. An outer shell 46 (commonly referred to in this art as "spool") is affixed to the outer race of each bearing assembly 44. The sleeve 48, which is typically formed of polymeric material, covers the outer shell 46. In this construction, the bowed roll 40 has a convex side 50 and a concave side 52. The bowed roll 40 is mounted in mounting brackets 58 which enable the roll 40 to be mounted at any angle to vary the location of the roll's apex 54 with respect to a traveling web under process.

In operation, the bowed roll 10 is positioned so that a web approaches the roll 10 from the concave side 50 and leaves on convex side 50. In this way, the web is spread out in the cross machine direction. The sleeve 48 expands with rotation from the concave side 52 of curved axle 12 to the convex side 50.

The bowed roll 40 may be located between a lead-in guide roll 60 and a lead-out guide roll 62 to expand a travelling web 64 (FIG. 6B). The spreading of travelling web 64 starts when the web 64 leaves the lead-in roll 60. The bowed shape of the roll 40 causes the web to spread in the cross-machine direction. As the web 64 exits the bowed roll 40, spreading is complete. To prevent the web's tendency to revert back to its original shape, the lead-out roll 62 is located just downstream of the bowed roll 40. By varying the configuration of the bowed roll 40, the web 64 can be spread evenly from the center to both outside edges of the roll, or spread more to the center than the edges to correct baggy centers, or more at the edges to correct slacking edges.

Figure 5B:
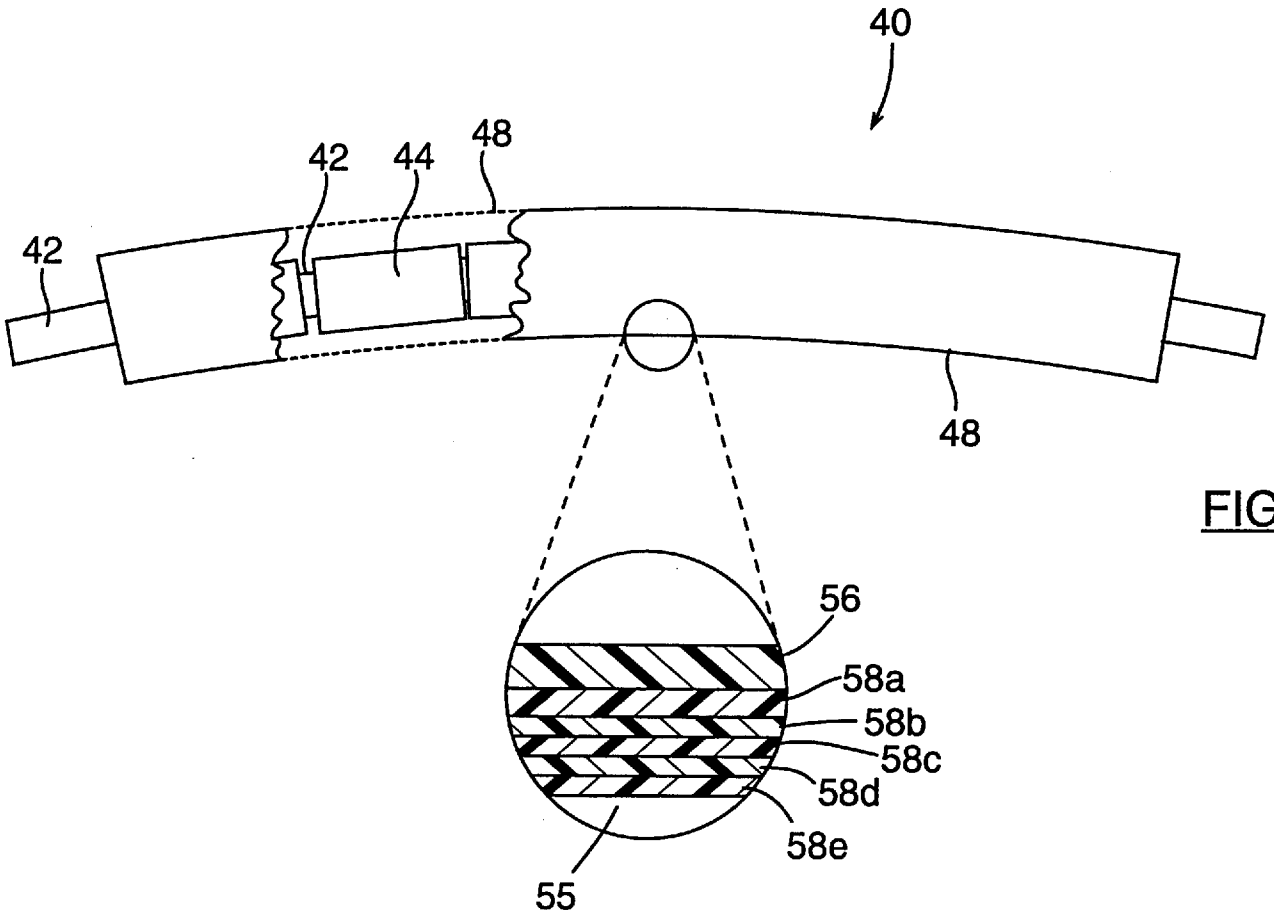
FIG. 5B is a partial section view of a bowed roll illustrating the adhesive and multiple release layers of a release coating of the present invention.

Referring now to FIG. 5B, the sleeve 48 is covered with a release coating 55 of the present invention comprising an adhesive layer 56 and a multiplicity of release layers 58*a,* 58*b,* 58*c,* 58*d,* 58*e*. The release coating 55 prevents a travelling web from sticking to the bowed roll 40 while providing a sufficient rigid surface for processing. It is also contemplated that bowed rolls lacking elastomeric sleeves may have each outer shell 46 of each individual bearing assembly 44 covered with the release coating of the present invention.

Figure 8:
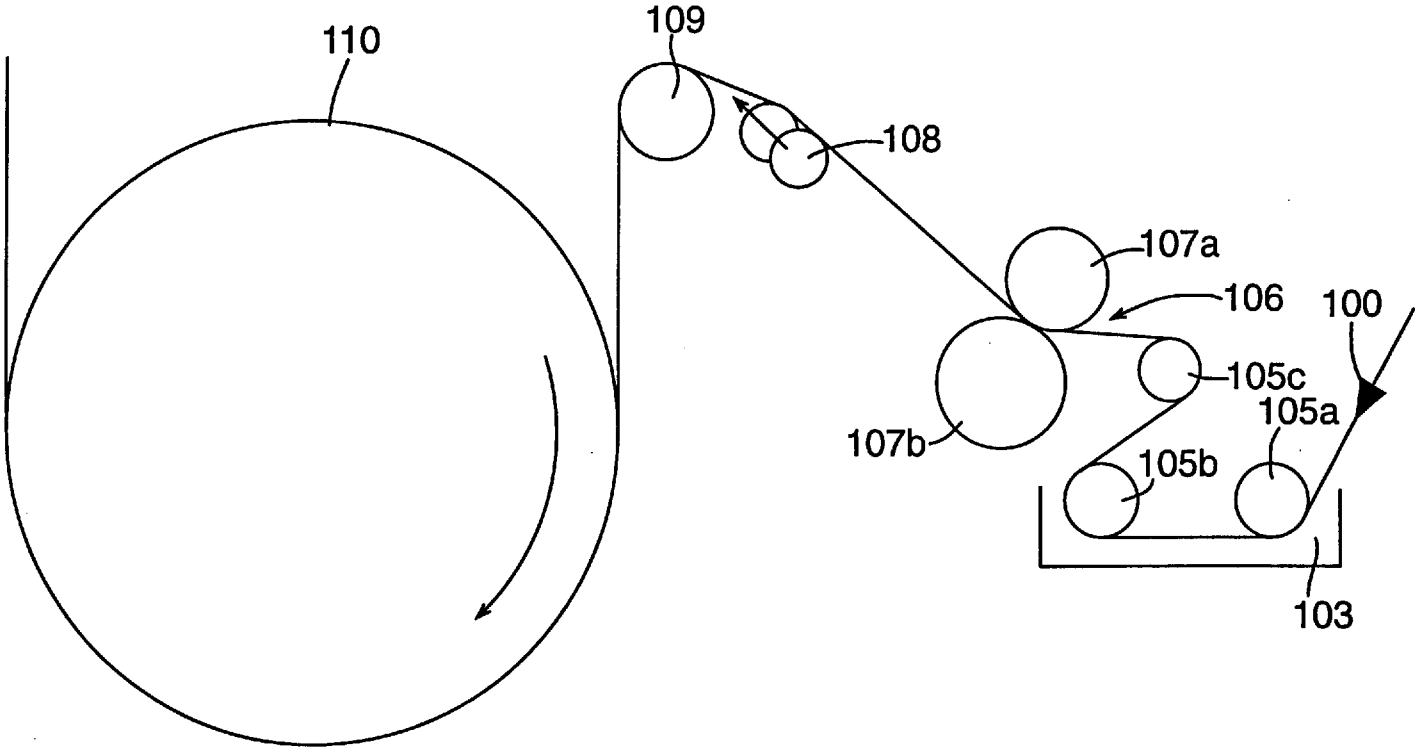
FIG. 8 is a diagram illustrating how a bowed roll located in spaced relationship with press rolls and a size bath can be employed to process paper.

Rolls having release coatings in accordance with the present invention can be advantageously employed in mills for making sized, filled and coated paper. For example, as shown in FIG. 8, rolls covered with the release coating of the present invention can be used in a process for coating paper. A web 100 enters a size bath 103 containing a viscid liquid coating 104. As the web 100 is completely coated, it is processed under and over three carrying rolls 105*a*–105*b* and passed through a nip press 106 comprising press rolls 107*a* and 107*b*. The web 100 is then spread by a bowed roll 108 (represented by the double circle and arrow symbol well-known to those skilled in this art) and a carrying roll 109 prior to the removal of moisture, and finally is cured by a rotating heated roll 110. When the release coating of the present invention is applied to the machine elements described above, the travelling web 100 fails to adhere to the various roll surfaces.

Figure 9:
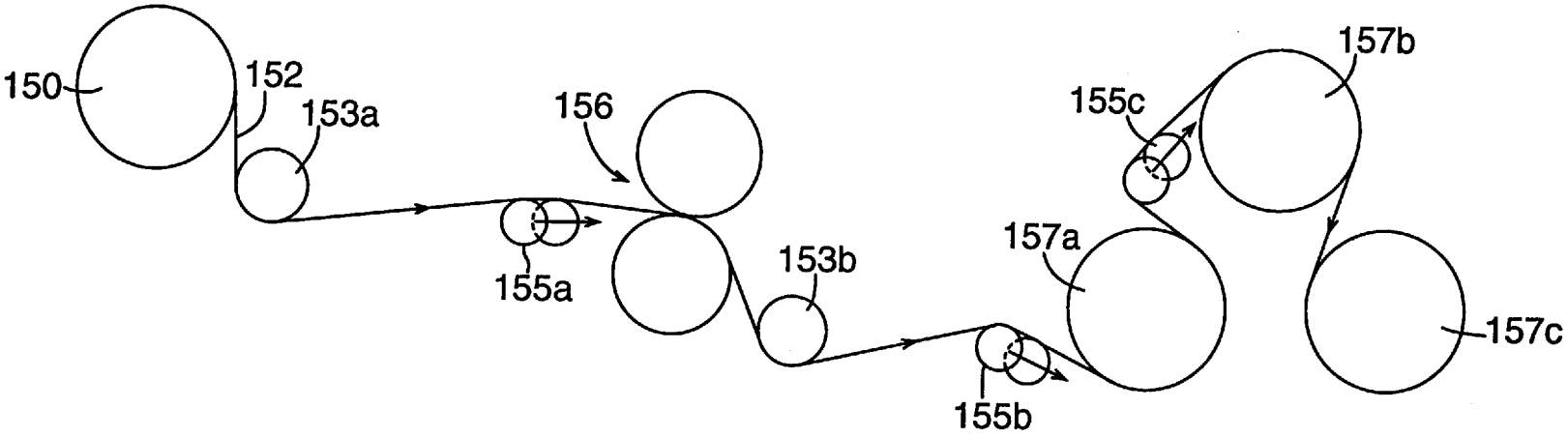
FIG. 9 is a diagram illustrating a system of machine elements used to transport a viscid web.

FIG. 9 shows diagrammatically how a feed roll 150 supplies a web 152 over a pair of carrying rolls 153*a* and 153*b*. A bowed roll 155*a* covered with the release coating of the present invention is located upstream of a size press 156 and maintains the web 152 under even crosswise tension before saturation with viscid matter. Two bowed rolls 155*b* and 155*c* are also covered with the release coating of the present invention, and, in conjunction with the drier rolls 157*a,* 157*b* and 157*c,* are used to eliminate web wrinkles and control baggy centers and slack edges.

Figure 10:
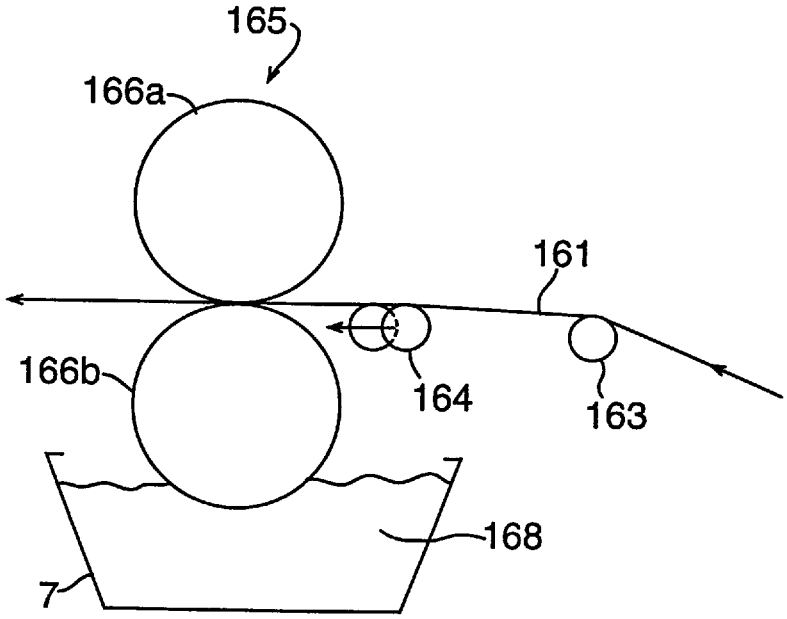
FIG. 10 is a diagram illustrating a coating process.

FIG. 10 illustrates diagrammatically a web 161 passing over a carrying roll 163, a bowed roll 164, through a coating station 165 comprising press rolls 166*a* and 166*b,* and into a coating bath 167 which contains viscid matter 168. The bowed roll 164, which is covered with the release coating of the present invention, is located upstream of a coating station to eliminate wrinkles.

Figure 11:
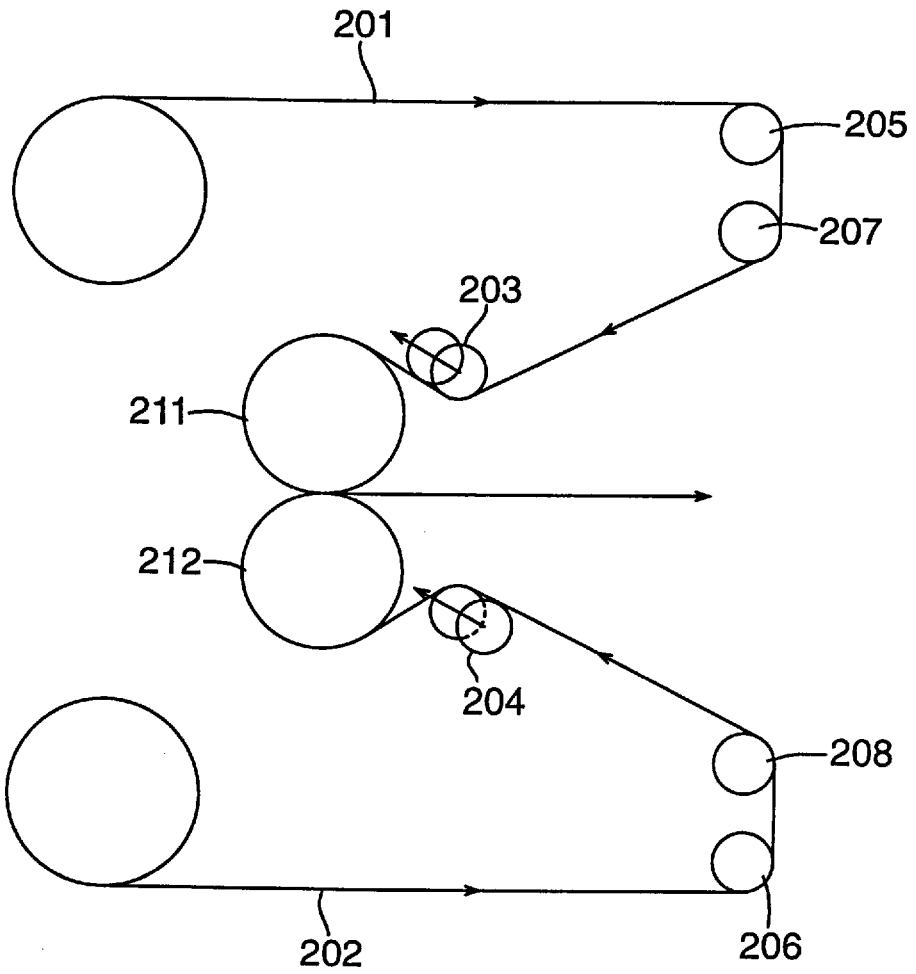
FIG. 11 is a diagram illustrating a system of machine elements used to transport and laminate two viscid webs in a laminating process.

FIG. 11 illustrates the lamination of two sheets 201 and 202 and shows how two bowed rolls 203 and 204 and from carrying rolls 205, 206, 207 and 208, each of which are covered with the release coating of the present invention, can be arranged to keep the sheets 201 and 202 wrinkle-free and under even tension, thereby avoiding air bubbles in the lamination at lamination rolls 211, 212.

The present invention is further illustrated by the following non-limiting example.

EXAMPLE

In this example, the adhesive and release layers comprise the solutions tabulated by percentage weight in TABLES 1 and 2, respectively.

TABLE 1

| Adhesive Layer Composition | |
|---|---|
| Component | Weight Percent |
| 2 Phenoxyethyl Acrylate | 30.5 |
| 1,6 Hexanediol Diacrylate | 18.0 |
| Ethoxylated Bisphenol A Diacrylate | 19.0 |
| Polyurethane Diacrylate | 31.0 |
| Benzophenone | 0.5 |
| Benzildimethylketal | 1.0 |

TABLE 2

| Release Layer Composition | |
|---|---|
| Component | Weight Percentage |
| 2 Phenoxyethyl Acrylate | 26.5 |
| 1,6 Hexanediol Diacrylate | 15.6 |
| Ethoxylated Bisphenol A Diacrylate | 16.7 |
| Polyurethane Diacrylate | 26.5 |
| Epoxy Polymethylsiloxane | 13.0 |
| Diethoxy Acetophenone | 0.5 |
| Benzophenone | 0.4 |
| Benzildimethylketal | 0.8 |

The solutions which comprise the adhesive and release coatings, respectively, are mixed in separate mixing vessels for 15 minutes before use and continuously thereafter throughout the application of the coating to the machine element. Both coating solutions are held at elevated temperature, preferably at about 150° F., and are continuously mixed in their respective pressure vessels, preferably at a mixing speed of about 200 rpm.

Figure 7:
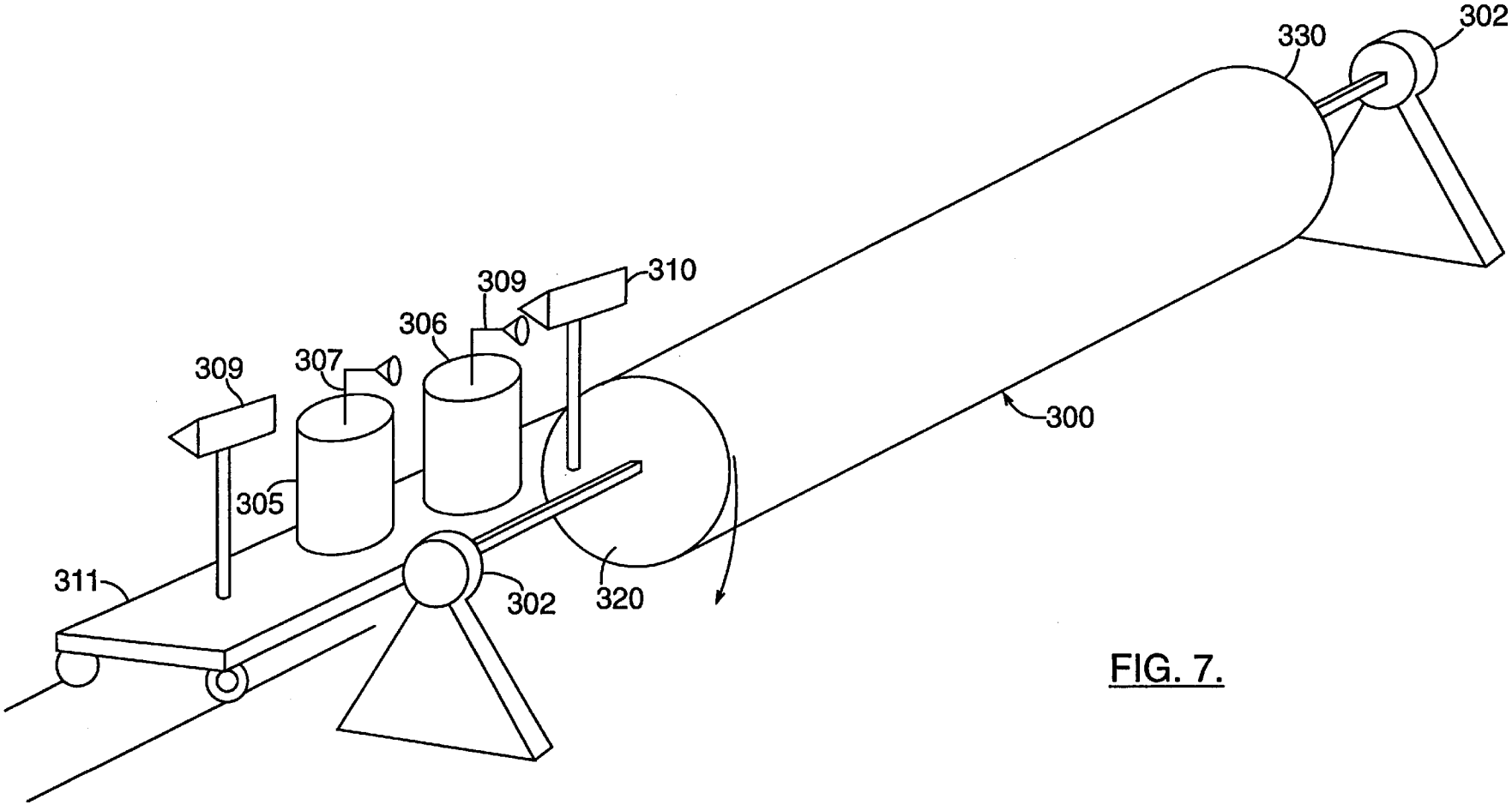
FIG. 7 is a perspective view illustrating the application of a release coating of the present invention to a machine element.

With reference to FIG. 7, an exemplary roll 300 for receiving the release coating, having a 7 inch diameter is mounted rotatably in bearings 302 and 303. The adhesive and release coating chemical compositions of Tables 1 and 2 are contained in reservoirs 305 and 306, respectively. The reservoirs 305, 306 have sprayheads 307 and 308, respectively, and supported on a traversing carriage 311. Curing ultraviolet lamps 309 and 310 are mounted on both sides of the spray heads 307 and 308 to allow coating and curing in both directions. The spray heads 307, 308 are configured for low pressure and high volume application.

Still referring to FIG. 7, the adhesive coating admixture is applied with a pressure of 50 psi from the mixing vessel 305 through the sprayhead 307 to form an initial adhesive layer on the surface of the rotating roll 300 with a film thickness of approximately 0.003". The rotational surface speed of the roll 300 is approximately 30 feet per minute, and the speed of the carriage is 60 inches per minute. The adhesive layer application starts at one end 320 of the roll 300 and proceeds beyond the opposite end 330 as the following uv lamp 309 is activated to effect a partial cure of the applied coating layer. These lamps 309, 310 are 12 inches long and deliver 450 watts per inch of lamp length.

The second coating layer, which serves as the first release layer, is then applied over the initial adhesive layer in the opposite direction (i.e., from end 330 to end 320) using the ultraviolet lamp 310 to partially cure that layer. Traversing from end to end, the application of additional release layers is repeated until a desired coating thickness of 0.060 inch is applied and partially cured. After applying the final release layers, the carriage traverse speed is reduced to 20 inches per minute, and both ultraviolet lamps 309, 310 are used for curing. This increases the radiant energy per square inch of coating by a factor of six to complete the radiant energy curing of the coating. Further post cure is accomplished by moisture and room temperature thermal curing for several days. Over spray is removed from the air through a filtered exhaust system.

The release coating manufactured in accordance with the above has the properties indicated in TABLES 3 and 4.

TABLE 3

| Release values in pounds per inch of bond line using Scotch brand No. 230 3M Drafting and Universal Brand No. 51301 Masking Tape. | | |
|---|---|---|
| | 3M 230 | Universal 51301 |
| UV Release Coating | .08 | .25 |
| Teflon polymer Tube | .11 | .38 |

TABLE 4

| Coefficient of Friction of Draft Paper on Coating Surface. | |
|---|---|
| UV Release Coating | .07 |
| Teflon Polymer Tube | .09 |

This coating can also be applied to a roll that is installed in a process machine located at an end user's production facility using transportable portable application and over spray accumulating filtered exhaust systems.

In the foregoing specification, the invention has been described with reference to specific exemplary embodiments thereof. It will, however, be evident that various modifications and changes may be made thereunto without departing from the spirit and scope of the invention as set forth in the appended claims. The drawings and specification are, accordingly, to be regarded in an illustrative rather than in a restrictive sense.

What is claimed is:

1. A roll having thereon a coating comprising an adhesive layer and one or more release layers overlying said adhesive layer, said adhesive layer comprising an acrylated monomer, an acrylated urethane and a diacrylated aromatic monomer, wherein said acrylated monomer is a compound of Formula I $$\mathrm{Acr}—R_1 \qquad (I)$$

wherein Acr is an acrylate group of Formula II $$H_2C{=}CR_2—\overset{\overset{\displaystyle O}{\|}}{C}—O— \qquad (II)$$

with $R_2$ being H, methyl or ethyl, and wherein $R_1$ is alkyl, aryl, alkyl aryl, alkoxy, alkoxy aryl, alkoxy alkyl, any of which may be unsubstituted or substituted from 1 to 6 times with methyl, ethyl, methoxy, ethoxy, or hydroxyl, or one time with epoxy; or said acrylated monomer is a compound of Formula III $$\mathrm{Acr}—R_3—\mathrm{Acr} \qquad (III)$$

wherein Acr is as defined hereinabove, and $R_3$ is alkyl, aryl, alkyl aryl, alkoxy, alkoxy aryl, alkoxy alkyl, any of which may be unsubstituted or substituted from 1 to 6 times with methyl, ethyl, methoxy, ethoxy, or hydroxyl, or one time with epoxy; and wherein said acrylated urethane is a compound of Formula IV $$\mathrm{Acr{-}R_4{-}O{-}\overset{\overset{\displaystyle O}{\|}}{C}{-}NH{-}R_5{-}Acr} \qquad \text{(IV)}$$

wherein Acr is as defined hereinabove, and $R_4$ and $R_5$ are alkyl, aryl, alkyl aryl, alkoxy, alkyl alkoxy, aryl alkoxy, alkyl amino, aryl amino, or aryl alkyl amino, each of which is unsubstituted or substituted from one to four times with methyl, ethyl, or hydroxyl; and wherein said diacrylated aromatic monomer is a compound of Formula V $$\mathrm{Acr{-}R_6{-}Acr} \qquad \text{(V)}$$

wherein Acr is as defined hereinabove, and $R_6$ is aryl, alkyl aryl, alkoxy aryl, or alkoxy alklyl aryl, each of which can be unsubstituted or substituted between 1 and 6 times with methyl or hydroxy; and said release coating comprising an acrylated monomer of Formula I or Formula III, an acrylated urethane of Formula IV, a diacrylated aromatic monomer of Formula V, and an acrylated polysiloxane of Formula VI $$\mathrm{Acr{-}R_8{-}\overset{\overset{\displaystyle R_7}{|}}{\underset{\underset{\displaystyle R_7}{|}}{\overset{\overset{\displaystyle O}{|}}{\underset{\underset{\displaystyle O}{|}}{Si}}}}{-}O{-}R_7} \qquad \text{(VI)}$$

wherein Acr is as defined above, $R_7$ is alkyl, and $R_8$ is alkyl that is unsubstituted or substituted 1 or 2 times with methyl or hydroxy.

2. The roll of claim 1, wherein $R_1$ is unsubstituted alkoxy aryl or alkoxy aryl substituted with hydroxy.

3. The roll of claim 1, wherein $R_2$ is hydrogen.

4. The roll of claim 1, wherein $R_3$ is unsubstituted alkyl or alkyl substituted with hydroxy.

5. The roll of claim 1, wherein $R_4$ is unsubstituted alkyl or alkyl substituted with methyl or hydroxy.

6. The roll of claim 1, wherein $R_5$ is alkyl aryl amino.

7. The roll of claim 1, wherein $R_6$ is alkyl aryl.

8. The roll of claim 1, wherein $R_7$ is methyl in all occurrences.

9. The roll of claim 1, wherein $R_8$ is unsubstituted alkyl.

* * * * *